US005641378A

United States Patent [19]

Luhman et al.

[11] Patent Number: 5,641,378

[45] Date of Patent: Jun. 24, 1997

[54] HAND APPLICATOR FOR ADHESIVE SHEETING

[75] Inventors: Robert A. Luhman, New Richmond, Wis.; Craig D. Thompson, Inver Grove Heights, Minn.

[73] Assignee: Minnesota Mining and Manufacturing Company, St. Paul, Minn.

[21] Appl. No.: 580,399

[22] Filed: Jan. 19, 1996

Related U.S. Application Data

[63] Continuation of Ser. No. 306,698, Sep. 15, 1994, abandoned.

[51] Int. Cl.[6] ..... B44C 1/10

[52] U.S. Cl. ..... 156/577; 156/540; 156/574; 206/411; 242/564.3; 242/557

[58] Field of Search ..... 156/540, 577, 156/579, 541, 574; 242/557, 564.3; 206/411

[56] References Cited

U.S. PATENT DOCUMENTS

| | | | |
|---|---|---|---|
| 2,503,741 | 4/1950 | Johnson . | |
| 2,569,140 | 9/1951 | Avery . | |
| 2,636,691 | 4/1953 | Fritzinger | 242/564.3 |
| 2,808,962 | 10/1957 | Warmath . | |
| 2,912,140 | 11/1959 | Cole . | |
| 3,283,886 | 11/1966 | Addis et al. . | |
| 3,308,002 | 3/1967 | Hurwich et al. | 156/577 |
| 3,468,743 | 9/1969 | Soriano | 156/584 |
| 3,575,772 | 4/1971 | Billings | 156/540 |

(List continued on next page.)

FOREIGN PATENT DOCUMENTS 2196317 4/1988 United Kingdom ..... B65H 37/00

OTHER PUBLICATIONS

Instructions and Parts List for GRIP–A–TAB® brand Pressure Sensitive Tape and Label Dispensers, Cat. No. LH–31 Electric Label Dispenser Type 39300 Dated 1993.

Instructions and Parts List for GRIP–A–TAB® brand Pressure Sensitive Tape and Label Dispensers, Cat. No. LH–54 Manual Label Dispenser Type 27400 Dated 1975.

Instructions and Parts List for Scotch™ P/N 78–8028–8075–3 Liner Removal Attachment, For use with Scotch™M–87 Definite Length Dispenser Model 16700 Dated 1981.

Instructions and Parts List for Scotch™ LS–52 and LS–56 Label Dispensers Model 18600 Dated 1992.

Instructions and Parts List for Scotch™ LS–8 Manual Label Dispenser Model 17000 Dated 1974.

Instructions and Parts List for Scotch™ LS–2 Label Dispenser Model 16100 Dated 1976.

Two–sided page specification of Scotch Mark™ 1504–DR5 & 1504–D3 Diskette Labeling Systems Dated 1989.

Instructions and Parts List for Scotch™ S–625 Pad Applicator Model 59100 Dated 1993.

Specifications for Scotch™ S–625 Pad Applicator Model 59100 Dated 1992.

*Primary Examiner*—James Engel

*Attorney, Agent, or Firm*—Gary L. Griswold; Walter N. Kirn; Peter L. Olson

[57] ABSTRACT

An adhesive sheeting applicator and method adapted to dispense strips of adhesive-backed sheeting from a supply roll rotatably disposed thereon and to apply said strips of sheeting to a surface with a desired spacing between successive strips by advancing the applicator a distance along the surface, the sheeting on the supply roll being in successive cut strips applied to a continuous substrate liner. The applicator includes an application device for compressively engaging the adhesive of a strip of the adhesive sheeting to a surface commencing at a first end of the strip of adhesive sheeting and progressing to a second of the strip of adhesive sheeting as the applicator is advanced a distance along the surface and an adhesive sheeting spacing device for feeding a successive strip of adhesive sheeting from the supply roll to the application means as a function of the distance along the surface that the applicator has been advanced, whereby a desired spacing is achieved between successive strips of adhesive sheeting applied to the surface.

12 Claims, 4 Drawing Sheets

U.S. PATENT DOCUMENTS

| | | | |
|---|---|---|---|
| 3,740,299 | 6/1973 | Schroter et al. | 156/577 |
| 3,969,181 | 7/1976 | Seabold | 156/577 |
| 4,089,730 | 5/1978 | Mahn | 156/577 X |
| 4,236,950 | 12/1980 | Eigenmann | 156/577 X |
| 4,607,978 | 8/1986 | Eigenmann | 156/577 X |
| 4,718,971 | 1/1988 | Summers | 156/540 |
| 4,813,571 | 3/1989 | Slagter . | |
| 4,997,512 | 3/1991 | Manusch | 156/577 X |
| 5,009,739 | 4/1991 | Goodwin et al. | 156/384 |
| 5,038,492 | 8/1991 | Bryant | 206/411 |
| 5,049,229 | 9/1991 | Czech | 156/577 |
| 5,352,320 | 10/1994 | Schwartz et al. | 156/494 |
| 5,380,395 | 1/1995 | Uchida | 156/577 |

HAND APPLICATOR FOR ADHESIVE SHEETING

This is a continuation of application No. 08/306,698 filed Sep. 15, 1994 now abandoned.

FIELD OF THE INVENTION

The present invention relates to a hand applicator for adhesive sheeting and method of applying the adhesive sheeting to a surface. More particularly, the present invention relates to the application of butt cut or die cut strips from a supply roll of adhesive sheeting onto a surface at selected spacings between successive strips of sheeting.

BACKGROUND

The National Highway Traffic Safety Administration (NHTSA) has issued a final "conspicuity" rule requiring over-the-road trailers that are built on or after Dec. 1, 1993 to be equipped with retroreflective sheeting. This rule was published in the Federal Register, Vol. 57, No. 238, Thursday, Dec. 10, 1992, pages 58406–58413.

The rule, mandated by the Motor Carrier Safety Act of 1990, applies to new trailers with an overall width of 80 inches or more and a gross vehicle weight rating (gvwr) of more than 10,000 pounds. It applies to a great number of trailers having a generally rectangular shape, but also includes some trailers with unusual shapes on which compliance will be difficult. These unusually shaped trailers include pole trailers, tankers, car haulers, container chassis and other specialty equipment.

The patterns and dimensions of the reflective material as applied to the various trailers will vary some with obstructions, trailer shape, and other practical considerations, but the basic requirement is as follows:

Reflective sheeting must be applied in strips in a pattern of alternating white and red color segments to the side and rear of the trailer and in white only to the upper rear corners of the trailer. The reflective strips must be in widths of 50, 75, or 100 millimeters and in lengths of approximately 300 millimeters.

Rear reflective markings will include three elements:

(1) Horizontal reflective strips in alternating white and red colors across the full width of the trailer as close to the edges and as close to 1.25 meters from the road surface as practicable.

(2) Two pairs of white reflective strips applied horizontally and vertically to the right and left upper corner of the trailer body as close to the top and as far apart as possible.

(3) A reflective sheeting in alternating colors across the full width of the rear underside protection device of the trailer.

Side reflecting marking will include a pattern of horizontal strips in alternating colors, white and red, originating and terminating as close to the front and rear ends of the trailer and as close to 1.25 meters above the road surface as practicable.

It would be a decided advantage in the industry to have a dispenser and method capable of readily dispensing the relatively short strips of adhesive reflective sheeting required by the above rule at a selected spacing between successive strips. Such adhesive reflective sheeting is generally supplied in a lengthy roll on a paper core for ease of dispensing. The roll has a continuous length of substrate liner on which are mounted a series successive adhesive reflective strips. The adhesive reflective sheeting is reflective on one side for the viewing thereof and has the adhesive applied to the opposing side for a bonding application to a surface. The liner is applied to the adhesive-bearing side. The liner is removed prior to application of the reflective sheeting to a surface. The liner material is chosen such that the adhesive bond between the liner and the adhesive material is less than the adhesive bond between the reflective adhesive strips. This facilitates peeling the liner from the reflective sheeting and leaving the adhesive material in place on the adhesive reflective strips in order to form the bond with the surface to which the reflective sheeting is applied.

The applicator should be hand held and be capable of being operated easily by a sole operator. The applicator should be relatively light weight in order to minimize operator fatigue. It is very important that a continuous applying motion across a length of surface result in the application of spaced apart strips of reflective sheeting on the surface. The applicator should readily feed successive adhesive reflective sheeting for application to a surface, leaving a space of selected length between the preceding strip of adhesive reflective sheeting and the successive strip of adhesive reflective sheeting as desired without any activating action by the operator to advance successive strips of reflective sheeting. The applicator should additionally be useful in applying die cut labels and the like supplied from a roll successively onto a surface.

The applicator should provide for a clean, positive separation of the liner from the adhesive reflective strips. In the past, such separation has on occasion been hampered by an adhesive bond between the liner and the adhesive layer that tends to pull the liner along with the adhesive reflective sheeting as the adhesive reflective sheeting is being laid down on the surface.

SUMMARY OF THE INVENTION

The present invention meets the above stated needs, in particular the need for applying spaced apart reflective strips of adhesive sheeting with a continuous motion of the applicator. The invention is a compact, portable, hand held adhesive sheeting applicator. The applicator has a unique system for dispensing and applying a relatively short strip of adhesive sheeting from a supply roll to a surface at selected spacing intervals. The applicator is capable of advancing the successive butt cut or die cut adhesive sheeting for application to a surface, spaced apart from the preceding adhesive sheeting on the surface as desired. In this manner, the alternating, spaced apart sheeting required by the NHTSA rule is easily applied. A positive tensional force is applied to the liner to ensure a clean separation from the sheeting and discarding of the separated liner.

The adhesive sheeting applicator is adapted to dispense strips of adhesive-backed sheeting from a supply roll rotatably disposed thereon and to apply the strips of sheeting to a surface by continuously advancing the applicator a distance along the surface. The sheeting on the supply roll is in successive cut strips applied to a continuous substrate liner. The applicator includes an application device for compressively engaging the adhesive of a strip of the adhesive sheeting to a surface. The compressive force brings the adhesive disposed on the adhesive strip into firm contact with the surface, generating a strong bond therewith. The adhesive bonding is commenced at a first end of the strip of adhesive sheeting and progresses to a second of the strip of adhesive sheeting as the applicator is advanced a distance along the surface, thereby progressively bonding the full length of the adhesive strip to the surface. An adhesive sheeting spacing device for feeding a successive strip of adhesive sheeting from the supply roll to the application means as a function of the distance along the surface that the applicator has been advanced is included, whereby a desired spacing is achieved between successive strips of adhesive sheeting applied to the surface.

These figures, which are idealized, are not to scale and are intended to be merely illustrative and non-limiting.

DETAILED DESCRIPTION OF THE DRAWINGS

Figure 1:
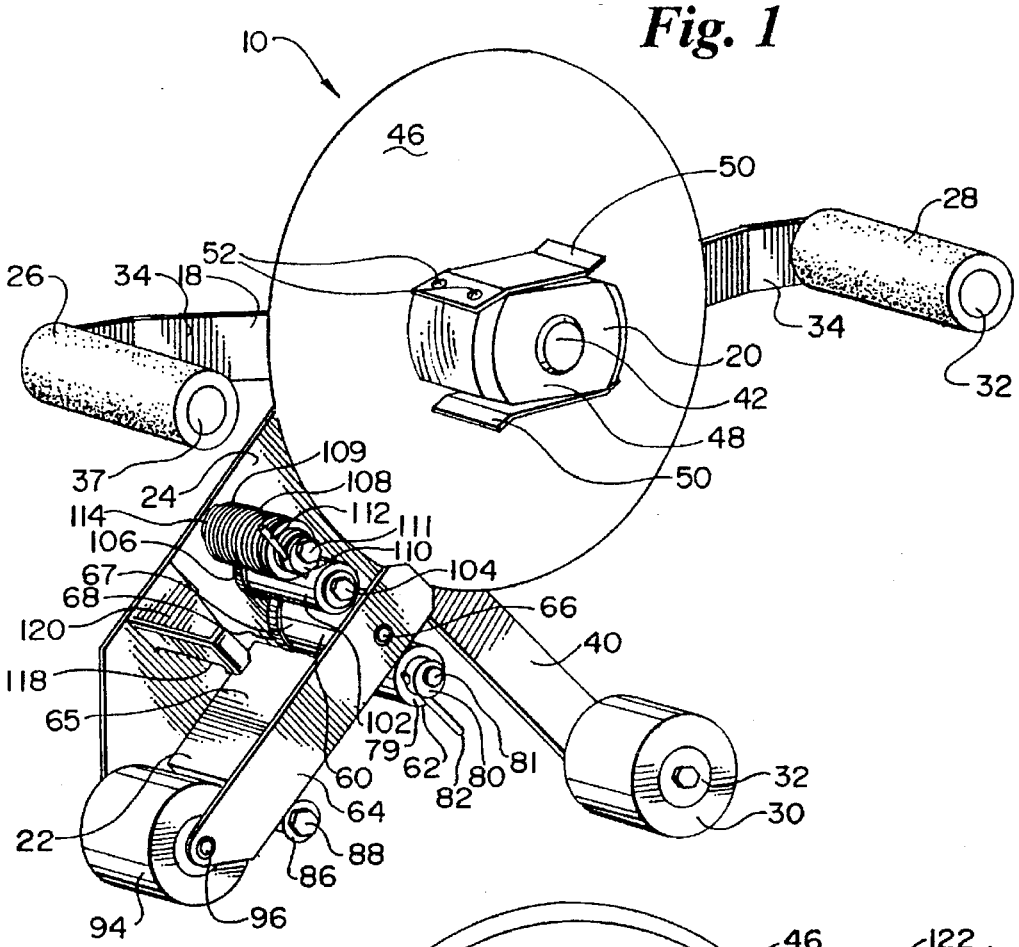
FIG. 1 is a perspective view of the applicator of the present invention.
Figure 2:
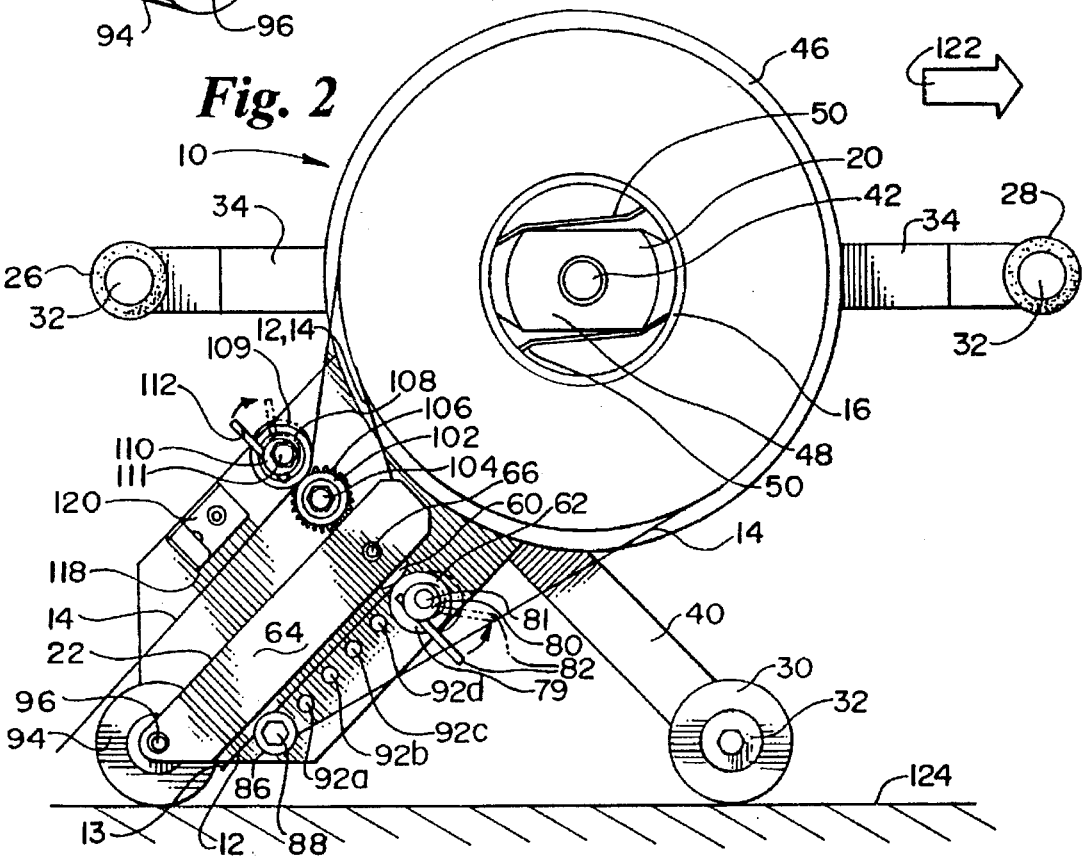
FIG. 2 is a front side elevational view of the applicator with the supply roll of reflective sheeting and liner shown installed thereon.

The adhesive sheeting applicator of the present invention is shown generally at 10 in FIGS. 1 and 2. The sheeting applicator is designed to apply butt cut or die cut adhesive sheeting 12 to a surface. As depicted in FIG. 2, the sheeting 12 is supplied adhered to a continuous liner 14 and is mounted in a roll on an expendable core 16. The core 16 is typically made of paper. In the drawings, the numerals 12 and 14 are indicated together where the adhesive sheeting 12 and the liner 14 are bonded together and the numerals 12 and 14 are used singly where the adhesive sheeting and the liner 14 are separated. The adhesive sheeting applicator 10 has three major subcomponents; support structure 18, supply roll drum 20, and application assembly 22.

Support structure 18 includes frame 24, handles 26, 28, and support roller 30. Frame 24 is preferably constructed of a single, lightweight sheet of material. The frame 24 is preferably formed from aluminum stock, but could also be formed from a plastic material such as a sheet of reinforced nylon or the like. In the preferred embodiment, the frame 24 provides a backing structure upon which the remaining components of adhesive sheeting applicator 10 are mounted, as will be described. Such components are affixed to the frame 24 by conventional devices. The preferred device is by a cap screw that passes through a bore in the frame 24 and into a threaded bore formed in the component.

Adhesive sheeting applicator 10 provides for two-handed operation by a sole operator. Accordingly, support structure 18 includes handles 26, 28. The handles 26, 28 are each mounted on posts 32. Posts 32 are a long, solid shafts that are conventionally affixed to support arm 34 by cap screw and threaded bore. Handles 26, 28 are preferably covered with a rubberized, spongy material so that the handles 26, 28 may easily be gripped by the operator. Handles 24, 26 are oriented transverse to the plane defined by the frame 24.

The handle support arms 34 are preferably formed of rectangular bars of a metallic material, such as aluminum. In a preferred embodiment, the handle support arms 34 are formed of a single bar that extends between the handles 26, 28 and is affixed to frame 24 in a conventional manner by a pair of cap screws 29 and threaded bores formed therein.

Support structure 18 additionally includes support roller 30. The support roller preferably has a relatively hard rubber surface that is adapted to rotationally engage the surface to which the strips of adhesive sheeting 12 is to be applied. Support roller 30 is mounted on an axle 32. Support roller 30 is free to rotate about axle 32. The axle 32 is mounted in a conventional manner to support arm 40 by a cap screw and threaded bore formed therein. The support arm 40 is affixed to the frame 24 in a conventional manner by a pair of cap screws and threaded bores formed therein.

The second major subcomponent of adhesive sheeting applicator 10 is supply roll drum 20. Supply roll drum 20 has an axial bore (not shown) defined therein and is mounted thereby on an axle 42. Axle 42 is mounted in conventional manner by a cap screw and threaded bore formed therein to frame 24. Supply roll drum 20 is free to rotate about axle 42. The supply roll drum 20 is preferably made of a plastic material that exhibits a low frictional engagement with the axle 42 to facilitate such rotation without the use of bearings or the like.

Supply roll drum 20 includes backing plate 46 that is affixed to and rotates with supply roll drum 20. Backing plate 46 is comprised of a relatively thin aluminum disc and is adapted to provide support for the core 16 and the sheeting 12, liner 14 that are wound thereon. In a preferred embodiment, backing plate 46 may have a series of relatively large holes (not shown) formed therein in order to lighten backing plate 46, without greatly affecting the strength thereof.

Supply roll drum 20 includes hub 48 that is adapted to closely engage the core 16. Hub 48 is designed to engage the inner diameter of the core 16 by the use of fingers 50, such that there is substantially no rotational slippage between the core 16 and hub 48. Fingers 50 are preferably made of a spring quality steel and are affixed at one end thereof to hub 48 by screws 52. When relaxed, as depicted in FIG. 1, the outward tips of fingers 50 normally have a radial distance from the center of hub 48 that is slightly greater than the inner radius of the core 16. When the core 16 is placed on hub 48, the fingers 50 are compressed inward, as depicted in FIG. 2, and are spring loaded to engage the inner surface of the core 16 by digging into the core 16 slightly when the fingers 50 are released.

The third major subcomponent of adhesive sheeting applicator 10 is application assembly 22. Application assembly 22 is depicted generally in FIGS. 1 and 2. Application assembly 22 includes a sheeting advance roller 60 and the cooperative sheeting pinch roller 62. Sheeting advance roller 60 is mounted between frame 24 and roller support 64. Roller support 64 is preferably formed from an elongated flat bar of aluminum stock. The roller support 64 is mounted on a spacer support 65. Spacer support 65 is conventionally affixed to frame 24 and provides the desired spacing from frame 24 necessary to accommodate sheeting advance roller 60.

Sheeting advance roller 60 has an axial shaft 66 that is rotatably supported at a first end by roller support 64 and is rotatably supported proximate a second end by frame 24. The axial shaft 66 is free to rotate within such supports. Bearings (not shown) are provided at each of the described support points to facilitate such rotation.

Sheeting advance roller 60 has a roller housing 67 that is mounted concentric to axial shaft 66. The exterior surface of roller housing 67 is preferably rubberized, having a relatively soft, deformable consistency in order to better engage the adhesive sheeting 12. A gear 68 is affixed to the roller housing 67 and rotates therewith. The gear 68 is held slightly apart from the frame 24 so that there is no interference with the free rotation thereof.

Figure 3:
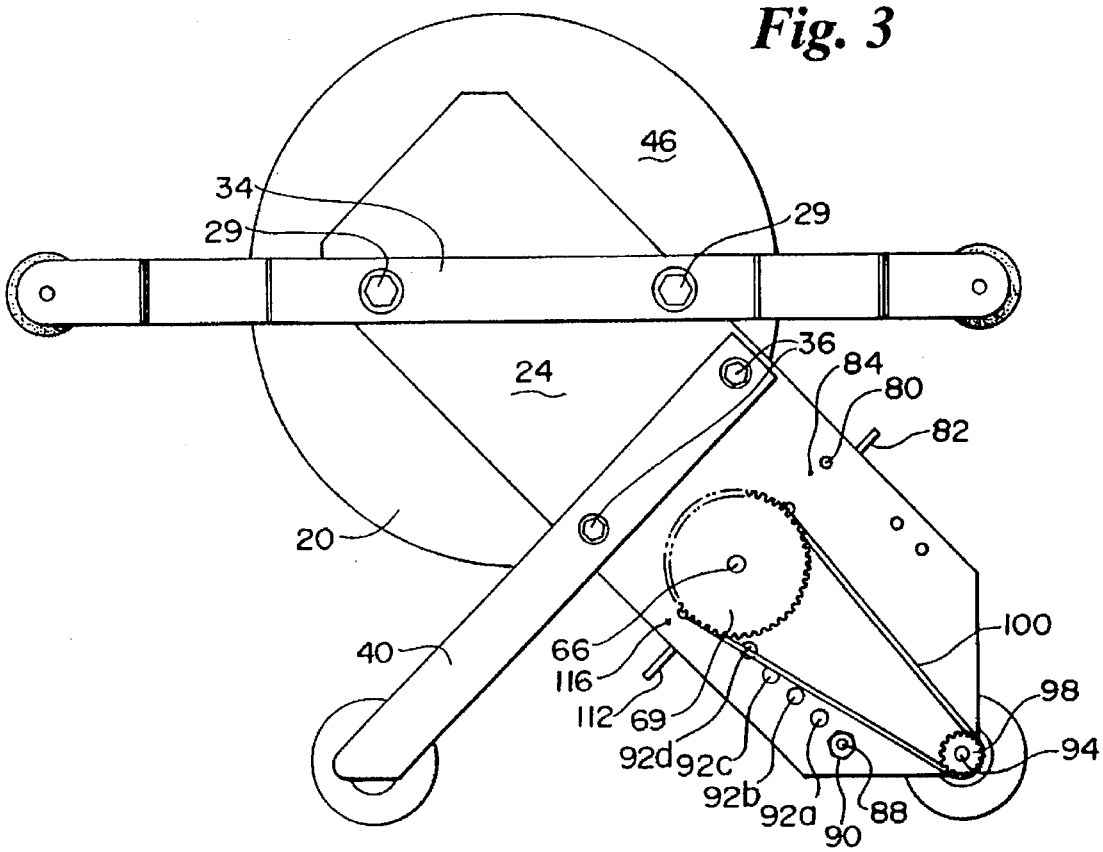
FIG. 3 is a rear side elevational view of the applicator with the gearing between the applying roller and the sheeting advance roller exposed.

Referring to FIG. 3, the axial shaft 66 of sheeting advance roller 60 passes through a bore in frame 24 and is affixed to toothed pulley 69 by a set screw or, alternately, by a press fit. Rotation of toothed pulley 69 results in the concurrent rotation of axial shaft 66 and of sheeting advance roller 60.

Figure 5:
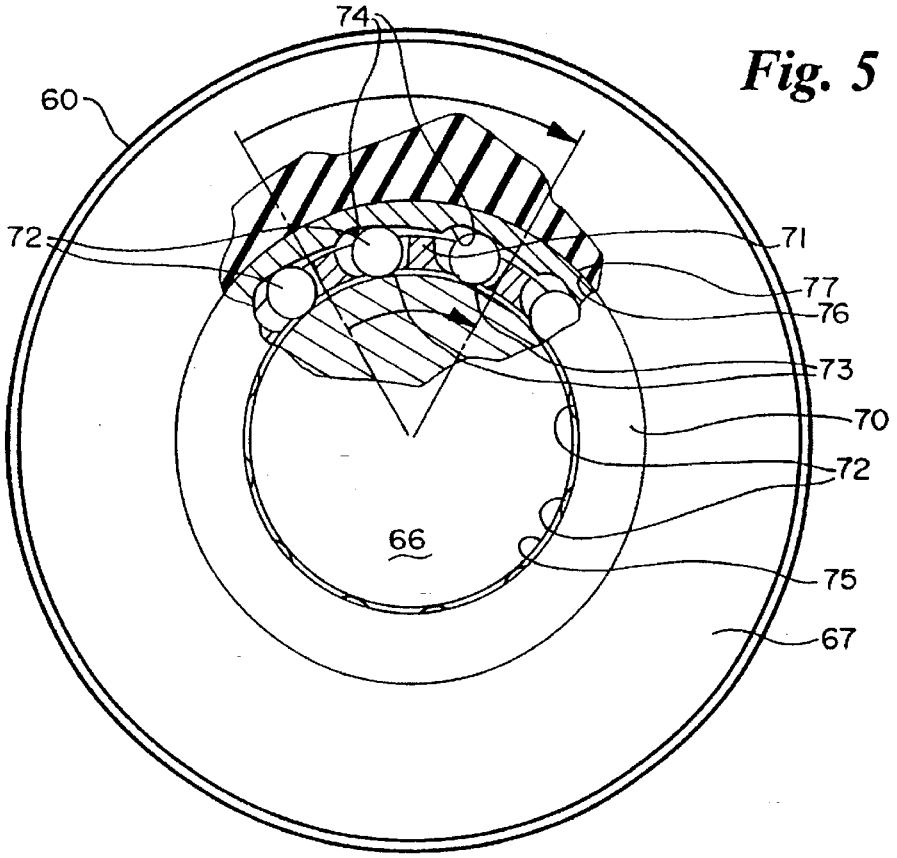
FIG. 5 is a side sectional view of a typical clutch as utilized in the sheeting advance roller as configured in the roller driven mode.
Figure 6:
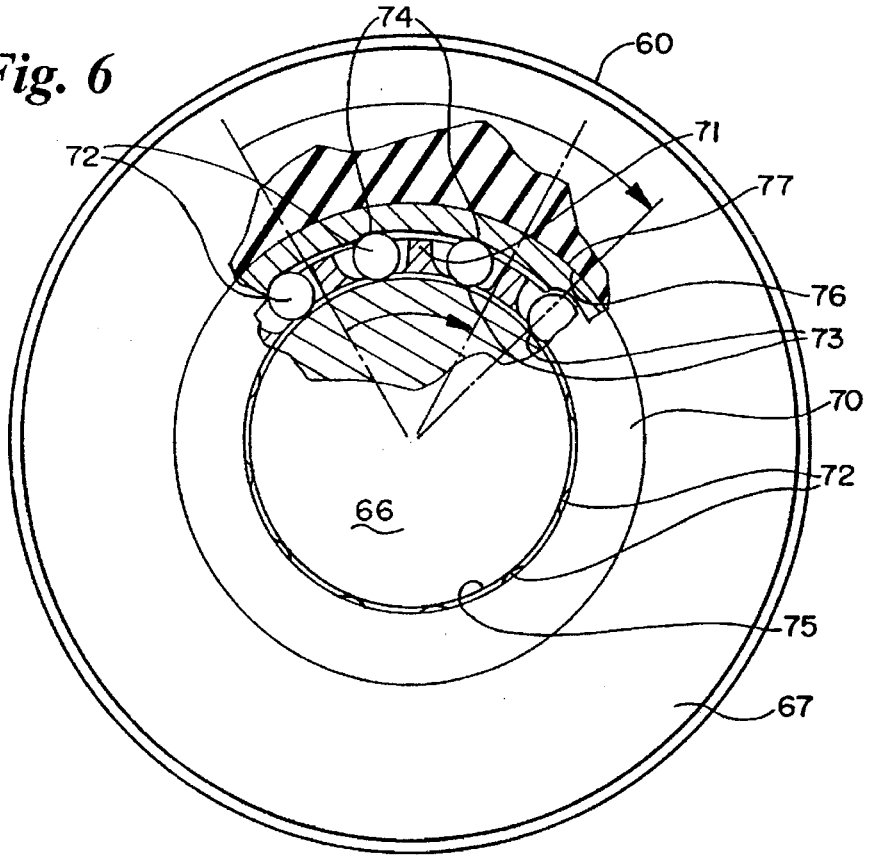
FIG. 6 is a side sectional view of a typical clutch as utilized in the sheeting advance roller as configured in the overdriven mode.

Referring to FIGS. 5 and 6, a clutch 70 is interposed between the axial shaft 66 and the roller housing 67 of sheeting advance roller 60. The clutch 70 can be any of a number of commercially available one-way clutches that are overdriven when rotated in a first direction and locked when rotated in a second direction. In a preferred embodiment, the clutch 70, as depicted in FIGS. 5 and 6, is commercially available from Torrington Company, 59 Field Street, Torrington, Conn. 06790.

Clutch 70 has a bearing ring 71 that provides rotational support for the plurality of ball or needle bearings 72. The bearing ring 71 has a plurality of bearing apertures 73 defined therein, each such aperture 73 that is paired with a bearing 72. The bearing apertures 73 are adapted to permit the bearings 72 to bear upon the exterior surface 75 of axial shaft 66 of sheeting advance roller 60.

A ramped roof 74 is formed in the bearing ring 71 generally opposed to each bearing aperture 73. The exterior surface 76 of the bearing ring 71 is fixedly engaged with the interior surface 77 of the roller housing 67, as by a press fit.

Clockwise rotation of axial shaft 66, as depicted in FIG. 5, causes the counter clockwise rotation of the ball bearings 72. This causes the ball bearings to become wedged against the ramped roof 74, which locks the clutch 70. The roller housing 67 is thereby caused to rotate with the axial shaft 66 when clutch 70 is in the depicted configuration.

Clockwise rotation of roller housing 67 relative to the axial shaft 66, as depicted in FIG. 6, is an overdriven condition that causes the clutch 70 to unlock. The bearings 72 move up the ramp of the ramped roof 74 and become disengaged therewith, thereby unlocking the clutch 70 and permitting the roller housing 67 to rotate free of the axial shaft 66. The overdriven condition exists even if axial shaft 66 is rotating in the clockwise direction as long as the clockwise rotational speed of roller housing 67 exceeds that of the axial shaft 66.

As depicted in FIGS. 1 and 2, the spring loaded sheeting pinch roller 62 normally bears on the surface of sheeting advance roller 60 to compressively engage the adhesive liner 14 that is adhered to sheeting 12 as the sheeting 12/liner 14 pass between the sheeting advance roller 60 and the sheeting pinch roller 62.

The spring loaded sheeting pinch roller 62 has sub components including a roller 79, a eccentric pinch roller axle shaft 80, an axle 81 and a coil spring (not shown). The roller 79 has a liner 14 engaging surface disposed thereon and is rotatably mounted on the eccentric pinch roller axle shaft 80. The eccentric pinch roller axle shaft 80 is rotatably mounted on the axle 81. The axle 81 is conventionally affixed to frame 24. The coil spring (not shown) is disposed generally concentric with the axle 81 proximate the frame 24. A first end of the coil of the coil spring is engaged with the pinch roller 62. A second end of the coil of the coil spring is engaged with the frame 24 by being inserted in spring retaining bore 84, as depicted in FIG. 3.

The spring is always under tension such that the spring applies a constant rotational bias to pinch roller 62 in a clockwise direction as depicted in FIG. 2. This bias urges the pinch roller 62 into compressive engagement with the sheeting advance roller 60 or with the liner 14 when the sheeting 12/liner 14 are threaded therebetween.

A lever arm 82 is affixed to sheeting pinch roller 62 to permit ready eccentric rotation of pinch roller 62 about axle 81. Actuation of lever arm 82 in the counter clockwise direction, as depicted in FIG. 2, increases the tension in the coil spring and eccentrically rotates the sheeting pinch roller 62 out of contact with the sheeting advance roller 60 to permit the ready threading of the sheeting 12/liner 14 therethrough. Upon release of the lever arm 82, the coil spring urges the sheeting pinch roller 62 to rotate clockwise, back into compressive engagement with the sheeting advance roller 60 and the sheeting 12/liner 14.

Peel roller 86 is depicted In FIGS. 1 and 2 spaced apart from the sheeting advance roller 60. Peel roller 86 is adapted to separate the liner 14 from the adhesive sheeting 12. The relatively stiff sheeting 12 advances on a generally straight line path from a point tangential to the sheeting advance roller 60 to a point tangential to an application roller 94. The peel roller 86 is disposed such that the sheeting 12 and the liner 14 pass tangential to the surface thereof. The sheeting 12 advances with the liner 14 facing such surface. Peel roller 86 is rotationally mounted on axial bolt 88. Axial bolt 88 is conventionally affixed to the frame by a cap screw and threaded bore arrangement. Peel roller 86 is free to rotate in either direction on bolt 88.

In an alternative embodiment, a stationary edge or relatively small diameter polished cylindrical (non-rotating) bar may be used instead of peel roller 86. Separation of liner 14 from adhesive sheeting 12 occurs because peel roller 86 defines an abrupt change in direction between a first path of adhesive sheeting 12 and a second path of liner 14. In addition, the adhesive sheeting 12 is normally formed of a material that has substantially greater stiffness than the very pliable material from which the liner 14 is formed. This encourages the adhesive sheeting 12 to proceed in a generally straight line path, while the direction of liner 14 is changed significantly. Peel roller 86 or the alternative embodiments thereof may vary in dimensions, but should be sufficiently small in diameter to achieve the abrupt change in path directions of adhesive sheeting 12 and liner 14 required for the efficient separation thereof.

The peel roller 86 is selectively positionable between sheeting advance roller 60 and application roller 94 by a plurality of adjusting bores **92*a*–92*d* formed in frame 24. As will be seen, the distance that the peel roller 86 is from the point of application of the adhesive sheeting 12 to a surface partially defines the spacing that will be formed between the successive strips of the adhesive sheeting 12 as applied to the surface. In a preferred embodiment, the spacing between the adjusting bores 92*a*–92*d* is selected to yield a set of desired spacings between the successive strips of the adhesive sheeting 12, for example, six inches, twelve inches, and eighteen inches. The peel roller 86 is moveable to the desired adjusting bore 92*a*–92*d* by simply removing the cap screw to free the peel roller 86 from the frame 24 and repositioning the peel roller to the adjusting bore 92***a*–92*d* corresponding to the desired spacing between the successive strips of sheeting 12.

Application roller 94 is located at the trailing edge of applicator 10. As shown in FIG. 2, application roller 94 is adapted to bear upon the surface of a trailer or the like to which the reflective sheeting 12 is being applied and thereby to compressively adhere the adhesive sheeting 12 to such surface.

Application roller 94 is fixedly mounted on a concentric axial shaft 96. The axial shaft has a relatively small first end that is rotationally fit into a bore formed in roller support 64. A second relatively small end passes through a bore formed in the frame 24 and projects beyond. The axial shaft 96 of the application roller 94 is free to rotate within the bores formed in roller support 64 and frame 24. Bearings may be included in such bores to facilitate such rotation.

A toothed pulley 98 is affixed to the second end of the axial shaft 96, as depicted in FIG. 3. The toothed pulley 98 is held spaced apart from the frame 24. Rotation of the application roller 94 results in rotation of the pulley 98. The toothed pulley 98 is coupled to the toothed pulley 69 of the sheeting advance roller 60 by toothed belt 100. In a preferred embodiment, the gear ratio of the toothed pulley 98 to the toothed pulley 69 is approximately 3:1.

The application assembly 22 further includes the liner advance roller 102. The liner advance roller is adapted to maintain tension on the liner 14 that has been separated from the sheeting 12 at peel roller 86, thereby assisting with the separation and keeping the separated liner 14 out of the way as the sheeting 12 is applied to the surface. The exterior surface of the liner advance roller 102 is preferably formed of a relatively hard rubber material.

The liner advance roller 102 has an axial bolt 104 passing therethrough. The axial bolt 104 is conventionally affixed to frame 24. The liner advance roller 102 is free to rotate about the axial bolt 104. A gear 106 is affixed to the liner advance roller 102. The gear 106 is meshed with the gear 68 of the sheeting advance roller 60. The gear 106 has slightly fewer teeth than the gear 68 such that rotation of the sheeting advance roller 60 results in a greater rotational speed of the liner advance roller 102.

As depicted in FIGS. 1 and 2, the spring loaded liner pinch roller 108 normally bears on the surface of liner advance roller 102 to compressively engage the separated liner 14 as liner 14 passes between the liner advance roller 102 and the liner pinch roller 108. In a preferred embodiment, the exterior, engaging surface of liner pinch roller 108 is formed of a relatively tacky rubber material to ensure a gripping engagement with the liner 14 in order to minimize the slippage of the separated liner 14 during passage between the liner advance roller 102 and the liner pinch roller 108.

The spring loaded liner pinch roller 108 has sub components including a roller 109, an eccentric pinch roller axle shaft 110, an axle 111, and a coil spring 114. The roller 109 has the liner 14 engaging surface disposed thereon and is rotatably mounted on the eccentric pinch roller axle shaft 110. The eccentric pinch roller axle shaft 110 is rotatably mounted on the axle 111. The axle 111 is conventionally affixed to frame 24. The coil spring 114 is disposed generally concentric with the axle 111 proximate the frame 24. A first end of the coil of the coil spring 114 is engaged with the pinch roller 109. A second end of the coil of the coil spring 114 is engaged with the frame 24 by being inserted in spring retaining bore 84, as depicted in FIG. 3.

The spring 114 is always under tension such that the spring 114 applies a constant rotational bias to liner pinch roller 108 in a counter clockwise direction as depicted in FIG. 2. This bias urges the liner pinch roller 108 into compressive engagement with the liner advance roller 102.

A lever arm 112 is affixed to liner pinch roller 108 to permit ready eccentric rotation of liner pinch roller 108 about axle 111. Actuation of lever arm 112 in the clockwise direction, as depicted in FIG. 2, increases the tension in the coil spring 114 and eccentrically rotates the liner pinch roller 108 out of contact with the liner advance roller 102 in order to facilitate the ready threading of the separated liner 14 therethrough. Upon release of the lever arm 112, the coil spring urges the liner pinch roller 108 to rotate counter clockwise, back into compressive engagement with the liner advance roller 102 and the threaded separated liner 14.

A serrated blade 118 is positioned proximate the liner advance roller 102 to facilitate the cutting and disposal of the separated liner 14 as desired. The blade 118 is supported on a blade bracket 120. Blade bracket 120 is conventionally affixed to frame 24.

Figure 7:
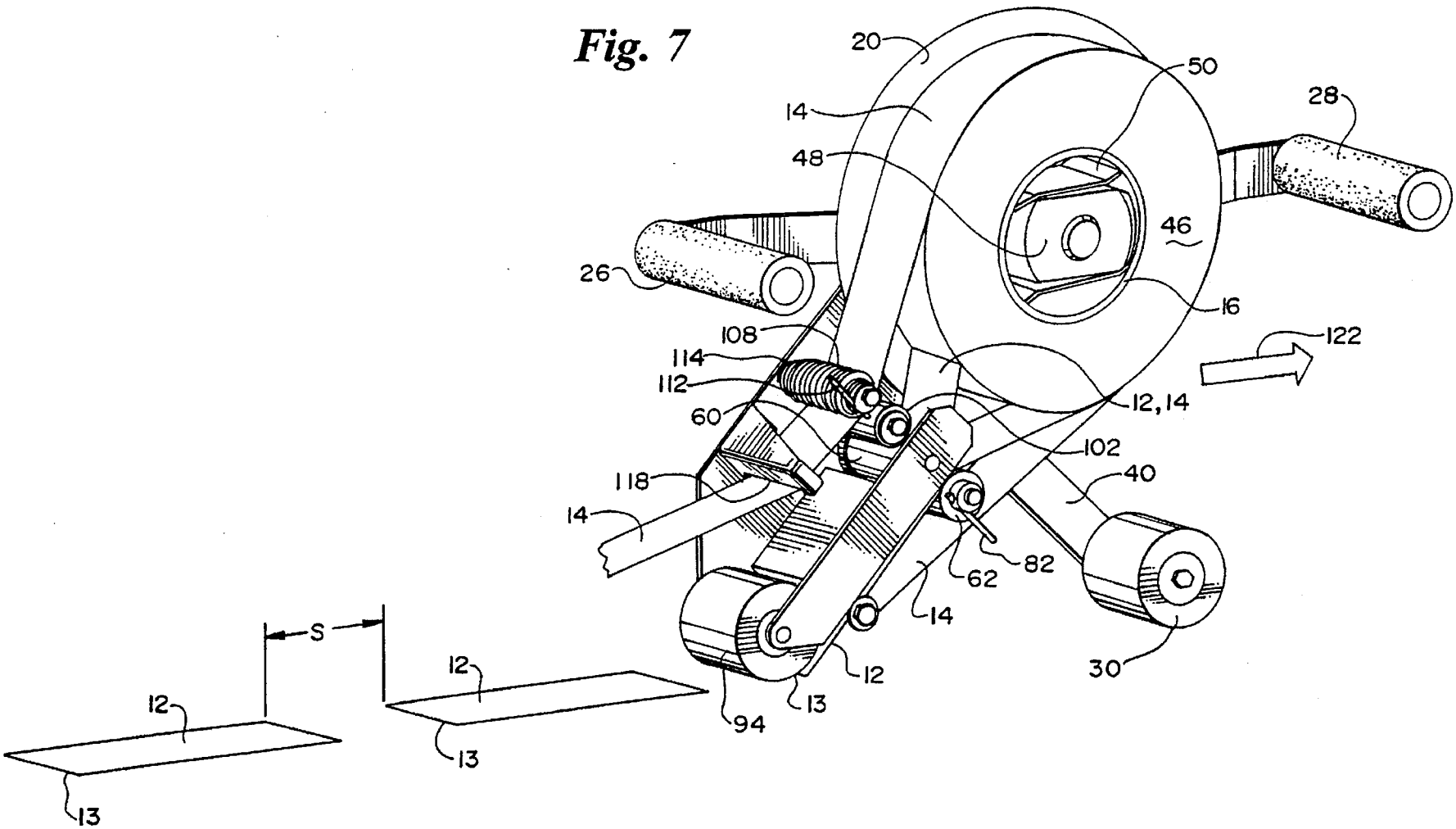
FIG. 7 is a perspective of the applicator with successive strips of sheeting applied at a selected spacing, S, on a surface.

The operation of the adhesive sheeting applicator 10 is best depicted in FIGS. 2 and 7. In operation, the roll of adhesive sheeting 12 is first loaded onto supply roll drum 20. To load the roll of adhesive sheeting 12 onto adhesive sheeting applicator 10, the core 16 thereof is pressed over the hub 48 of the supply roll drum 20. The roll of adhesive sheeting 12 is held in position by fingers 50 and will not become dislodged even if the applicator 10 is held with roll of adhesive sheeting 12 in the inverted position. The roll of adhesive sheeting 12 is so oriented with respect to applicator 10 that a rotation of supply roll drum 20 in the counter clockwise direction as depicted in FIG. 2 will cause the unwinding of the roll of adhesive sheeting 12. The leading edge 13 of the first strip of sheeting 12/liner 14 is fed off the front side of the roll, as indicated in FIG. 2. The lever arm 82 is rotated in a counter clockwise direction, opening a gap between the sheeting advance roller 60 and the sheeting pinch roller 62. The sheeting 12/liner 14 are brought around the underside of sheeting advance roller 60, through aforementioned gap and out beneath sheeting advance roller 60. The lever arm 82 may then be released and the spring bias of the pinch roller 62 rotates the pinch roller 62 back into contact with the sheeting advance roller 60.

At this point, the adhesive sheeting 12/liner 14 are brought across the peel roller 86 and the feed end of the liner 14 is manually separated from adhesive sheeting 12. The separated liner 14 is then pulled around the outside of the roll of adhesive sheeting 12/liner 14 in a counter clockwise direction. This action will force several strips of sheeting 12 to pass beneath application roller 94 and be expended. The lever arm 112 is rotated in the clockwise direction, opening a gap between the liner advance roller 102 and the liner pinch roller 108. The liner 14 is pulled through the gap until the liner 14 is pulled taught around the outside of the roll of adhesive sheeting 12 and liner 14. The lever arm 112 is then released, causing the liner pinch roller 108 to rotate counterclockwise into compressive engagement with the liner advance roller 102. The applicator 10 is then in the ready condition for application of strips of adhesive sheeting 12 to a surface 124.

Adhesive sheeting applicator 10 is brought into contact with surface 124 as depicted in FIGS. 2 and 7. Support roller 30 is in rolling contact with surface 124. The leading edge 13 of adhesive sheeting 12, with the adhesive exposed on the underside thereof, is routed beneath the application roller 94 and is brought into contact with surface 124. The operator applies downward pressure on handles 26, 28 and application roller 94 firmly tacks the leading edge 13 of adhesive sheeting 12 to surface 124. A strip of adhesive sheeting 12 is applied by moving adhesive sheeting applicator 10 to the right as indicated by arrow 122 in FIG. 2.

With the leading edge 13 of adhesive sheeting 12 adhered to surface 124, the continuous motion indicated by arrow 122 continues to withdraw sheeting 12/liner 14 across the surface of the sheeting advance roller 60, thereby rotating sheeting advance roller 60. The tangential velocity of the sheeting advance roller 60 is substantially equal to the linear velocity of advance of the applicator 10 along the surface 124 as generated by the operator of the applicator 10. The rotation of sheeting advance roller 60 acts to operate the clutch 70 of the sheeting advance roller 60 in the overdriven mode as depicted in FIG. 6.

The rotation of sheeting advance roller 60 in turn rotates the liner advance roller 102 via the interacting of the meshed gears 68 and 106. The rotation of the liner advance roller 102 exceeds the rotation of the sheeting advance roller 60. This causes the liner advance roller 102 to pull firmly on the liner 14, thereby separating the liner 14 from the sheeting 12 at the peel roller 86.

As the trailing edge of a strip of adhesive sheeting 12 passes over the peel roller 86, adhesive sheeting 12 is separated from the liner 14. At the time of such separation, the strip of adhesive sheeting 12 no longer exerts a rotational pull on the sheeting advance roller 60. At this point, the clutch 70 shifts to the locked mode as depicted in FIG. 5. As the operator continues to apply the strip of adhesive sheeting 12 to the surface 124, the application roller 94 continues to rotate, pressing the strip of adhesive sheeting 12 to the surface 124. This rotation rotates toothed pulley 98, which in turn rotates toothed pulley 69 by means of toothed belt 100. The sheeting advance roller 60 is thereby rotationally driven and the succeeding strip of adhesive sheeting 12 is advanced.

The speed of advance of the succeeding strip of adhesive sheeting 12 is significantly reduced due to the ratios of the diameters of the rollers 60 and 94 and to the ratios of the diameters of the pulleys 69 and 98. Effectively, the tangential velocity of the sheeting advance roller 60 is substantially reduced as compared to the tangential velocity of the application roller 94 along the surface 124. The reduced speed results in a selected spacing between successive strips of adhesive sheeting 12 as the successive strips of adhesive sheeting 12 are applied to the surface 124. The spacing, S, is depicted in FIG. 7. The application roller 94 covers a substantial distance along the surface 124 as the successive strip of adhesive sheeting 12 is advancing the significantly shorter distance from the peel roller 86 to the application roller 94. After applying a strip of adhesive sheeting 12, the application roller 94 must roll across a substantial length of the surface 124 before the slowly advancing succeeding strip of adhesive sheeting 12 advances the distance from the peel roller 86 to the application roller 94.

Figure 4:
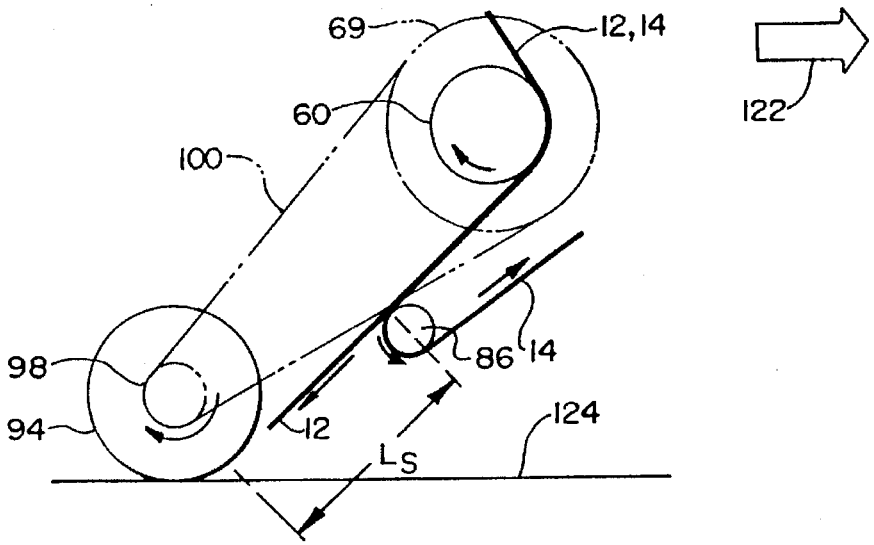
FIG. 4 is a schematic of the gearing between the applying roller and the sheeting advance roller shown in phantom and the interaction between the applying roller, peel roller, and the sheeting advance roller to dispense reflective sheeting at selected spacing and to discard the liner.

Generation of the above described spacing can be understood with reference to FIG. 4. The variable in determining the spacing between the successive strips of adhesive sheeting 12 is the approximate separation distance, $L_S$. The application roller 94 must rotate the distance of the spacing, S, between the strips of adhesive sheeting 12 plus the separation distance, $L_S$. At the same time, the sheeting advance roller 60 must rotate the separation distance, $L_S$. The separation distance, $L_S$ for the desired spacing, S, may be estimated by reference to the equation:

$$L_S = \frac{P_1 \times D_2 \times S}{(P_2 \times D_1 - P_1 \times D_2)}$$

where:

$P_1$ equals the diameter of pulley 98;

$P_2$ equals the diameter of pulley 69;

$D_1$ equals the diameter of application roller 94;

$D_2$ equals the diameter of sheeting advance roller 60;

S equals the spacing between the successive strips of sheeting 12 as applied to surface 124; and $L_S$ equals the distance from the liner 14 separation to the surface contact of adhesive sheeting 12.

By solving the above equation, it is possible to position the adjusting bores **92*a*–92*b* for known separation distances, $L_S$, from the liner separation point on the peel roller 86 to achieve desired separations, S, between successive strips of adhesive sheeting 12. By starting at an end of a relatively long surface 124, an operator is able to continually move the applicator 10 as indicated by the arrow 122 and apply successive adhesive strips 12** with a spacing, S, as determined by the above equation.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalence of those structures.

What is claimed:

1. An adhesive sheeting applicator adapted to dispense strips of adhesive-backed sheeting from a supply roll rotatably disposed thereon and to apply said strips of sheeting to a surface by advancing the applicator a distance along the surface, the sheeting on the supply roll being in successive cut strips, the strips of adhesive sheeting being adhesively applied adjacent to one another on a continuous substrate liner, comprising:

application means for compressively engaging the adhesive of a strip of the adhesive sheeting to a surface commencing at a first end of the strip of adhesive sheeting and progressing to a second end of the strip of adhesive sheeting as the applicator is continuously advanced a distance along the surface, comprising an application roller;

adhesive sheeting spacing means operably coupled to the application means for feeding a successive strip of adhesive sheeting from the supply roll to the application means as a function of the distance along the surface that the applicator has been continuously advanced, whereby a desired spacing is achieved between successive strips of adhesive sheeting applied to the surface, the adhesive sheeting spacing means having a sheeting advance roller being rotationally coupled to the application roller by a drive mechanism having a selected drive ratio whereby the rotation of the application roller in a selected direction at a selected tangential velocity rotationally drives the sheeting advance roller by means of the drive mechanism at a lesser tangential velocity and having a pinch roller in operable compressive engagement with the sheeting advance roller, the adhesive sheeting being compressively disposed between the advance roller and the pinch roller, the advance roller having one-way clutch means for selective rotational actuation of the advance roller responsive to the rotation of the application roller, whereby the adhesive sheeting is caused to be advanced between the advance roller and the pinch roller to the application roller to be applied to a surface; and liner separation means for positively separating the liner from the strips of adhesive sheeting by applying a tensional force to the liner as the adhesive sheeting spacing means feeds the successive strips of adhesive sheeting to the application means, the tensional force being sufficient to overcome the force of adhesion between the liner and the adhesive on the adhesive sheeting.

2. An adhesive sheeting applicator as claimed in claim 1 wherein the liner separation means includes a liner advance roller and a biased pinch roller, the pinch roller being biased in compressive rotational engagement with the liner advance roller, the liner advance roller being coupled to the sheeting advance roller by a liner advance roller drive mechanism and being rotationally driven thereby.

3. An adhesive sheeting applicator as claimed in claim 2 wherein the liner advance roller drive mechanism includes a drive ratio such that the sheeting advance roller rotationally drives the liner advance roller at a tangential velocity that is greater than the tangential velocity of the sheeting advance roller.

4. An adhesive sheeting applicator as claimed in claim 3 further includes a peel roller disposed adjacent to a path of advance of the adhesive sheeting, the path of advance being defined between the sheeting advance roller and the application roller, and being adapted to substantially alter the path of travel of the liner with respect to the path of advance of the adhesive sheeting so as to separate the liner from the adhesive sheet.

5. An adhesive sheeting applicator as claimed in claim 4 wherein the spacing between successive strips of adhesive sheeting applied to the surface is a function of the distance that the peel roller is from the application roller.

6. An adhesive sheeting applicator as claimed in claim 1 wherein the one-way clutch is disengaged in an overdriven mode during application of a strip of adhesive sheeting to the surface and is engaged in a locked mode during passage of the application roller through the space between successive strips of adhesive sheeting when no strip of adhesive sheeting is being applied to the surface.

7. An adhesive sheeting applicator as claimed in claim 1 wherein the one-way clutch is disengaged from operating in an overdriven mode during application of a strip of adhesive sheeting to the surface, drivingly disengaging the sheeting advance roller from the application roller, and is engaged in a locked mode during passage of the application roller through the space between successive strips of adhesive sheeting when no strip of adhesive sheeting is being applied to the surface, drivingly engaging the sheeting advance roller to the application roller.

8. An adhesive sheeting applicator adapted to dispense strips of adhesive-backed sheeting from a supply roll rotatably disposed thereon and to apply said strips of sheeting to a surface by continuously advancing the applicator a distance along the surface, the sheeting on the supply roll being in successive, adjacent cut strips applied to a continuous substrate liner, comprising:

a frame;

a supply roll drum rotatably coupled to the frame having a drum adapted to support the supply roll of adhesive sheeting thereon;

a sheeting advance device operably coupled to the frame having a sheeting advance roller and a cooperative pinch roller adapted to compressively, rotatably engage the adhesive sheeting and liner and withdraw the adhesive sheeting and liner from the supply roll, the sheeting advance roller being mounted on a rotatable axle and having a one-way clutch disposed therebetween, the clutch having a locked mode of operation wherein the rotatable axle is engaged with the sheeting advance roller and an overdriven mode of operation wherein the rotatable axle is disengaged from the sheeting advance roller;

an application roller adapted to receive the adhesive sheeting from the sheeting advance device, the adhesive sheeting defining a path of advance and to compressively bring the adhesive sheeting into contact with the surface;

a drive mechanism operably coupling the application roller to the rotatable axle of the sheeting advance roller whereby rotation of the application roller in a selected direction causes rotation of the sheeting advance roller when the one-way clutch is in the locked mode of operation; and a peel roller operably coupled to the frame and disposed between the sheeting advance roller and the application roller having a surface generally tangential to the path of advance of the adhesive sheeting and being adapted to substantially diverge the direction of travel of the liner from path of advance of the adhesive sheeting, whereby advancing the applicator continuously for a distance along the surface causes the rotation of the application roller, the application roller in turn rotationally drives the sheeting advance roller to advance successive strips of adhesive sheeting to the application roller when the one-way clutch is in the locked mode of operation, the drive mechanism having a rotational ratio such that the speed of advance of the adhesive sheeting is less than the speed of advance of the application roller along the surface, thereby generating a spacing of a selected length between successive strips of adhesive sheeting as applied to the surface.

9. An adhesive sheeting applicator as claimed in claim 8 further including a liner advance device operably coupled to the frame having a liner advance roller and a cooperative pinch roller adapted to compressively, rotatably engage the liner, applying a tensional force thereto and acting in cooperation with the peel roller to urge the liner to separate from the adhesive sheeting, the liner advance roller being rotationally coupled to the sheeting advance roller such that rotation of the sheeting advance roller causes rotation of the liner advance roller.

10. An adhesive sheeting applicator as claimed in claim 8 wherein the one-way clutch is disengaged while in the overdriven mode of operation during application of a strip of adhesive sheeting to the surface and is engaged in the locked mode of operation during passage of the application roller through the space between successive strips of adhesive sheeting when no strip of adhesive sheeting is being applied to the surface.

11. An adhesive sheeting applicator as claimed in claim 8 wherein the one-way clutch is disengaged while in the overdriven mode of operation during application of a strip of adhesive sheeting to the surface, drivingly disengaging the sheeting advance roller from the application roller, and is engaged in the locked mode of operation during passage of the application roller through the space between successive strips of adhesive sheeting when no strip of adhesive sheeting is being applied to the surface, drivingly engaging the sheeting advance roller to the application roller.

12. A method of dispensing strips of adhesive-backed sheeting from an adhesive sheeting applicator having a supply roll rotatably disposed thereon, the sheeting on the supply roll being in successive, adjacent cut strips having a leading edge and a trailing edge and being applied to a continuous substrate liner, and to apply said strips of sheeting to a surface with a selected spacing between successive strips of adhesive sheeting, the adhesive sheeting applicator having an application roller adapted to translate across the surface and being spaced apart from an adhesive sheeting advance roller and being drivingly engaged therewith and a peel roller adapted to separate the liner from the strips of adhesive sheeting being disposed between and spaced apart from the application roller and the adhesive sheeting advance roller, comprising the steps of:

generating a continuous translating motion of the adhesive sheeting applicator across the surface in a desired direction of travel;

applying a first strip of adhesive sheeting to the surface commencing at the leading edge thereof during a first portion of the continuous translating motion by compressively engaging the first strip to the surface with the application roller whereby, after engagement of the leading edge of the strip of adhesive sheeting with the surface, the continuous translating motion acts to unwind the strip of adhesive sheeting from the supply roll and separates the liner from the strip of adhesive sheeting at the peel roller;

advancing a successive strip of adhesive sheeting from the peel roller to the application roller, whereby the rolling engagement of the application roller with the surface during a second portion of the continuous translating motion across a selected space of the surface drives the advance roller and the continuous translating motion thereby acts to unwind the strip of adhesive sheeting from the supply roll, separates the liner from the strip of adhesive sheeting at the peel roller and advances the leading edge of the successive strip of adhesive sheeting to the application roller; and applying the successive strip of adhesive sheeting to the surface commencing at the leading edge thereof during a third portion of the continuous translating motion by compressively engaging the successive strip to the surface with the application roller after the application roller has traversed the selected space of the surface;

whereby the selected space of the surface between successive strips of adhesive sheeting is a function of the driving engagement between the application roller and the advance roller and the distance that the peel roller is disposed from the advance roller.

* * * * *